United States Patent [19]

Amagai et al.

[11] 4,085,816

[45] Apr. 25, 1978

[54] HEAT SHIELD FOR AN EXHAUST TAIL PIPE

[75] Inventors: Susumu Amagai; Shizuya Kawai; Hiroyasu Kan, all of Yokohama; Hideo Aizawa, Yokosuka, all of Japan

[73] Assignee: Nissan Motor Co., Ltd., Japan

[21] Appl. No.: 672,464

[22] Filed: Mar. 31, 1976

[30] Foreign Application Priority Data

Apr. 4, 1975 Japan ..... 50/40921

[51] Int. Cl.[2] ..... B60K 13/04

[52] U.S. Cl. ..... 180/64 A; 248/62; 403/202

[58] Field of Search ..... 180/64 A; 248/62, 66; 60/299, 320; 181/72, 36 C; 403/386, 202

[56] References Cited

U.S. PATENT DOCUMENTS

| | | | |
|---|---|---|---|
| 2,744,706 | 5/1956 | Gerdy | 180/64 A |
| 3,237,716 | 3/1966 | Parsons | 181/72 |
| 3,261,579 | 7/1966 | Engman et al. | 180/64 A |
| 3,491,849 | 1/1970 | Newkirk | 181/72 |
| 3,677,364 | 7/1972 | Pawlina | 181/72 |
| 3,863,445 | 2/1975 | Heath | 180/64 A |
| 3,905,564 | 9/1975 | Furlano | 181/72 |
| 3,963,087 | 6/1976 | Gorsseau | 180/64 A |

FOREIGN PATENT DOCUMENTS

| | | | |
|---|---|---|---|
| 766,527 | 9/1967 | Canada | 180/64 A |

*Primary Examiner*—David M. Mitchell

*Attorney, Agent, or Firm*—Robert E. Burns; Emmanuel J. Lobato; Bruce L. Adams

[57] ABSTRACT

A heat shield surrounds an exhaust tail pipe of an internal combustion engine so as to define a certain thickness of an insulating layer of air between the shield and the tail pipe.

5 Claims, 13 Drawing Figures

HEAT SHIELD FOR AN EXHAUST TAIL PIPE

BACKGROUND OF THE INVENTION

The present invention relates generally to a heat shielding apparatus for an exhaust tube of an internal combustion engine vehicle and particularly to the apparatus for the exhaust tube arranged beneath a body portion of the vehicle.

SUMMARY OF THE INVENTION

It is an object of the present invention to provide a new heat shielding apparatus which is fixed around an exhaust tube of an internal combustion engine for effectively shielding heat radiation from the exhaust tube when the engine is running.

It is another object of the present invention to provide the apparatus which can prevent direct contact of inflammable such as dry grass on the road surface with the hot exhaust tube.

It is another object of the present invention to provide the apparatus which comprises a heat shielding cylindrical plate concentrically positioned and radially spaced apart from the exhaust tube by spacing means.

It is still another object of the present invention to provide an improved arrangement of the heat shielding apparatus to the exhaust tube, in which longitudinal thermal expansion occurring in the exhaust tube hardly effects the mechanical properties of the heat shielding apparatus.

BRIEF DESCRIPTION OF THE DRAWINGS

These and other objects and advantages of the present invention will become more apparent from the following detailed description taken in conjunction with the accompanying drawings, wherein.

DESCRIPTION OF THE PREFERRED EMBODIMENTS

Figure 1A:
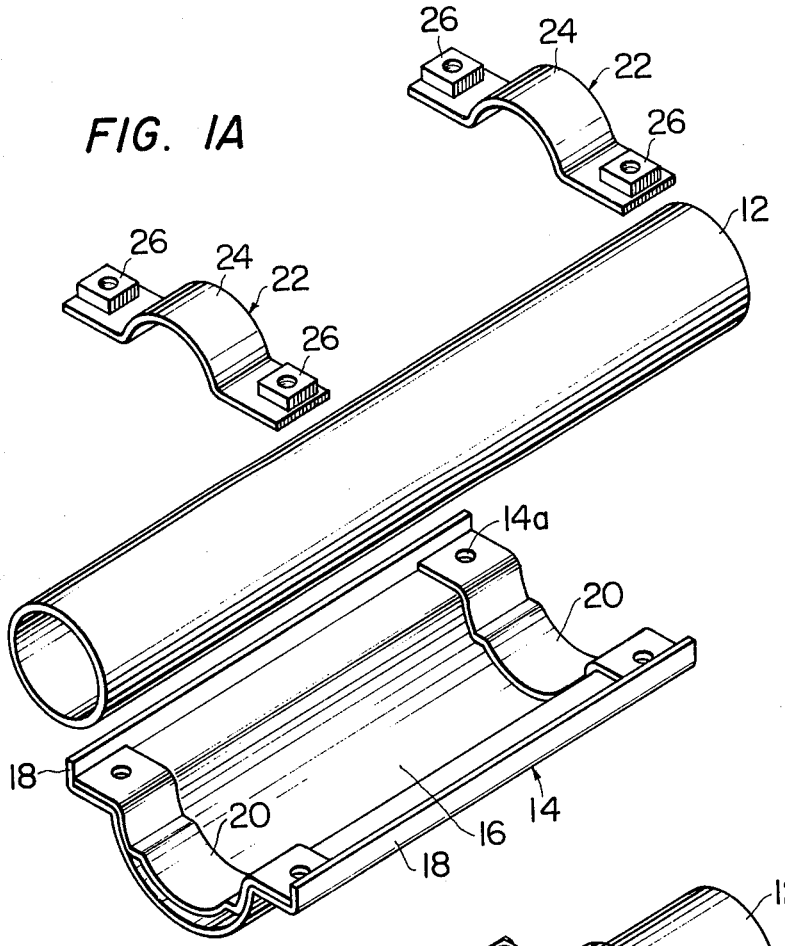
FIG. 1A is a perspective view of elementary parts of a heat shielding apparatus of a first preferred embodiment, accompanying an exhaust tube, according to the present invention.
Figure 1B:
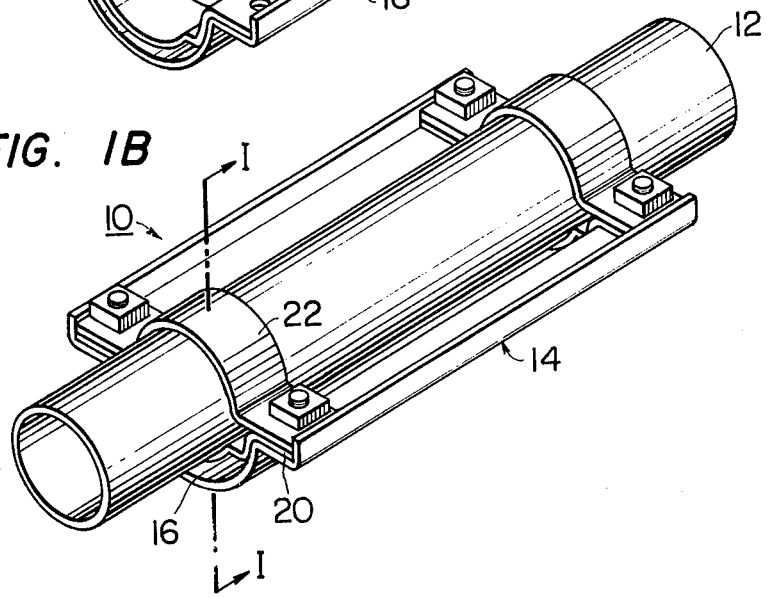
FIG. 1B is a perspective view of an assembled shielding apparatus of the first preferred embodiment.
Figure 1C:
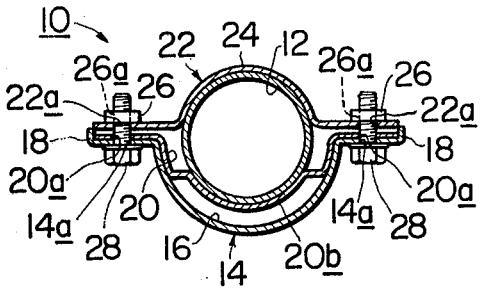
FIG. 1C is a sectional view taken along line I—I of FIG. 1B.

Referring now to FIGS. 1A, 1B and 1C of the appended drawings, there is shown the first preferred embodiment of the invention in which a heat shielding apparatus 10 is attached to a cylindrical exhaust tube 12 leading from an internal combustion engine (not shown).

As best seen from FIG. 1A, the heat shielding apparatus 10 comprises a generally rectangular heat shielding plate 14 formed with a concave recess 16 along the longitudinal center line portion thereof and a pair of upwardly extending flange portions 18 at the side edges thereof. As well shown in FIG. 1C, the radius of the concave recess 16 is suitably larger than that of the exhaust tube 12 so as to provide a certain thickness of an insulating layer of air between them as will be described hereinafter. Four corners of the heat insulating plate 14 are provided with holes **14*a***.

On both longitudinal ends of the heat shielding plate 14 are mounted two spacing or bridge members 20 each of which is bent at the generally middle portion thereof toward the bottom of the concave recess 16 and is provided with two holes **20*a* at both ends thereof, the holes 20*a* being arranged to align with the corresponding holes 14*a* of the heat shielding plate 14. As shown in FIG. 1C, each of the spacing members 20 has a round section 20*b* at the bent portion thereof to firmly receive a part of the exhaust tube 12. In this embodiment, the radius of the round section 20*b* is the same as that of the exhaust tube 12**.

Two bracket members 22 having raised portions 24 at the generally middle portion thereof are used for connecting the heat shielding plate 14 and the spacing members 20 to the exhaust tube 12. Each bracket member 22 is formed at both ends thereof with respective holes **22*a*. On both ends of each bracket member 22 are connected respective nuts 26 each of which has a hole 26*a* aligning with the corresponding hole 22*a* of the bracket members 22**.

These parts, such as the heat shielding plate 14, the spacing members 20 and the bracket members 22 are fastened to each other while enclosing the exhaust tube 12 by means of screw bolts 28 passing through the holes **14*a*, 20*a*, 22*a* and 26*a***, as well seen in FIGS. 1B and 1C.

Figure 2:
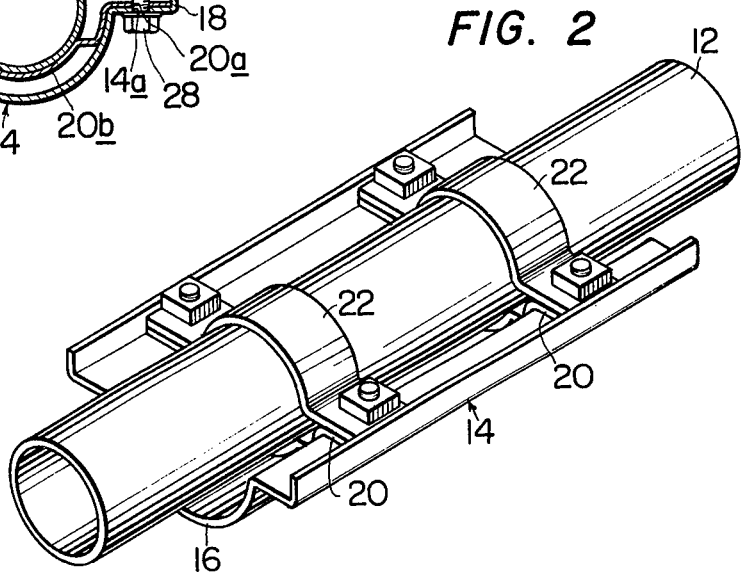
FIGS. 2 and 3 are perspective views showing other arrangements of the parts, with the exhaust tube, employed in the apparatus of FIG. 1A.

FIG. 2 shows a slightly modified arrangement of the parts of the heat shielding apparatus to the exhaust tube 12, in which each unit consisting of the spacing member 20 and the bracket member 22 is located toward the center portion of the heat insulating plate 14.

Figure 3:
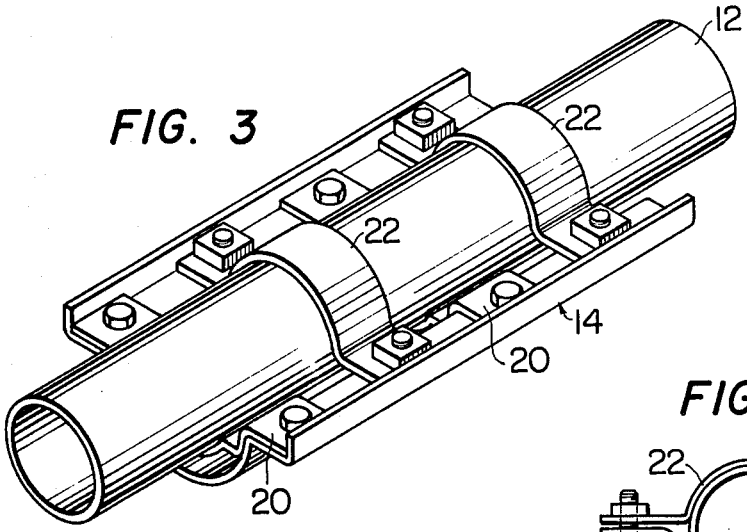

FIG. 3 shows still another modified arrangement of the parts, in which the spacing members 20 and the bracket members 22 are positioned alternately along the exhaust tube 12.

Figure 4:
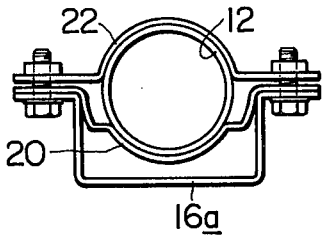
FIG. 4 is a sectional view of a slightly modified heat shielding apparatus of the first preferred embodiment.

If desired, the recess provided in the heatshielding plate 14 may be formed to have a rectangular cross section **16*a***, as shown in FIG. 4.

With the above described construction of the heat shielding apparatus 10, heat developed in the exhaust tube 12 is caused to transfer to the heat shielding plate 14 mainly through the small sized spacing members 20 which can not convey heat very well. Accordingly, the heat shielding plate 14 is prevented from being heated to an extremely elevated temperature.

Furthermore, when the exhaust tube 12 expands by the heat of the exhaust gases, the radial expansion of the exhaust tube 12 is preferably absorbed by the round section **20*b* of the spacing member 20. In this case, the round section 20*b* is moved downwardly toward the bottom portion of the concave recesss 16. Furthermore, in this condition, the longitudinal expansion of the exhaust tube 12 is achieved without affecting the arrangement of the parts of the apparatus 10 since the apparatus 10 is constructed to slidably receive therein the exhaust tube 12**.

Furthermore, during running of the vehicle, the space defined between the exhaust tube 12 and the concave groove 16 is well ventilated by fresh air so that the heat shielding plate 14 is cooled well.

Figure 5A:
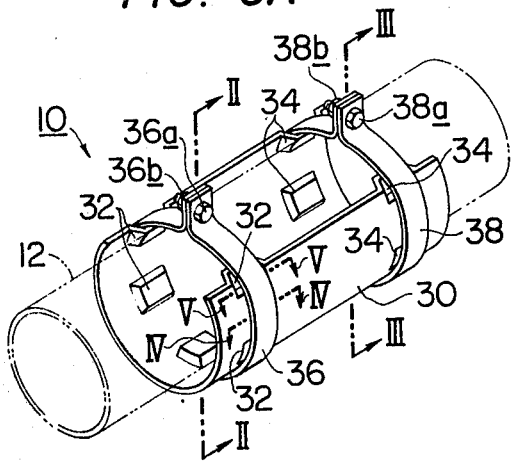
FIG. 5A is a perspective view of an assemblied heat shielding apparatus of a second preferred embodiment, accompanying an exhaust tube indicated in phantom lines, according to the present invention.
Figure 5B:
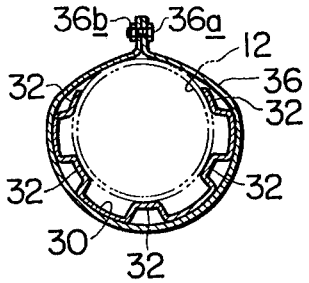
FIGS. 5B and 5C are sectional views taken along lines II—II and III—III of FIG. 5A.
Figure 5C:
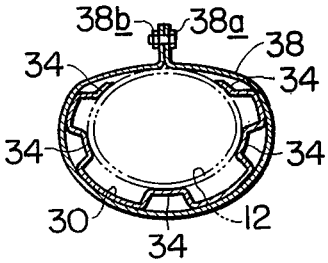
Figure 5D:
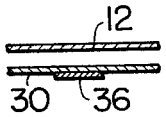
FIGS. 5D and 5E are sectional views taken along lines IV—IV and V—V of FIG. 5A.
Figure 5E:
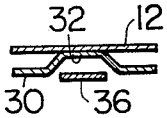

FIGS. 5A and 5E show the second preferred embodiment of the present invention.

In this embodiment, the heat shielding apparatus 10 comprises a generally cylindrical heat shielding plate 30 which has a radius suitably larger than that of the exhaust tube 12. At both longitudinal end portions of the heat shielding plate 30 are formed with first and second groups of embossed sections 32 and 34 which are projected inwardly so as to contact with the outer surface of the exhaust tube 12. Although, in this embodiment, each group has five embossed sections, it is also possible to provide more or fewer numbers of embossed sections to the heat shielding plate 30.

Embossed sections 32 of the first group are firmly connected at the inwardly projecting top ends thereof to the outer surface of the exhaust tube 12 by a suitable technique such as welding, while the embossed sections 34 of the second group are arranged to slidably contact, at the top ends thereof, with the exhaust tube 12.

Two clamping bands 36 and 38 are employed to firmly fasten the heat shielding plate 30 to the exhaust tube 12. Each of the clamping bands 36 and 38 has both ends connectable with each other by a bolt **36*a* (38*a*) and a nut 36*b* (38*b*). It should be noted that these clamping bands are arranged about the shielding plate 30 so as to enclose the recesses defined by the embossed sections 32 and 34, as shown in FIG. 5E**.

In the construction of this second embodiment, the heat transfer between the exhaust tube 12 and the heat shielding plate 30 is mainly made through the embossed sections which are incapable of conveying large amounts of heat by their limited contacting area to the exhaust tube 12. Therefore, the heat insulating plate 30 is prevented from being over-heated.

In this second embodiment, it should be noted that there is almost no chance that some inflammable material, such as dry grass on a road, accidentally contacts the extremely heated portions of the recesses defined by the first and second embossed sections 32 and 34 to burn. This is because of the fact that all recesses are enclosed by the clamping bands 36 and 38, as mentioned before.

It is also to be noted that, in this embodiment, the longitudinal expansion of the exhaust tube 12 does hardly affect the shielding apparatus 10 since the second group of embossed sections 34 are not firmly connected to the exhaust tube 12 but arranged to slidingly contact with the exhaust tube 12.

Figure 6A:
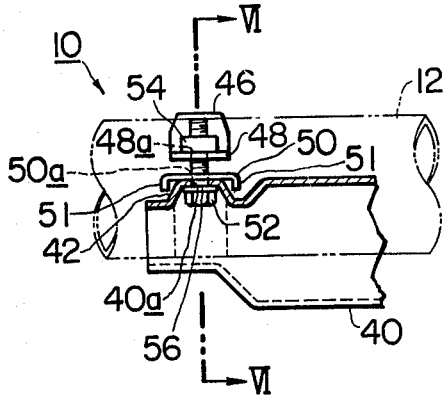
FIG. 6A is a sectional, partial view of an assemblied heat shielding apparatus of a third preferred embodiment, accompanying an exhaust tube indicated in phantom lines, according to the present invention.
Figure 6B:
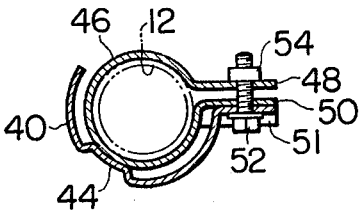
FIG. 6B is a sectional view taken along line VI—VI of FIG. 6A.

Referring to FIGS. 6A and 6B, the third preferred embodiment of the present invention is shown, in which the heat shielding apparatus 10 of the exhaust tube 12 comprises a generally cylindrical heat shielding plate 40 having along one side portion thereof a flange section 42 with a suitable number of holes **40*a* and along the longitudinal inner surface thereof a suitable number of embossed sections 44. The embossed sections 44 are used for contacting with the exhaust tube 12 in such a manner that the heat shielding plate 40 is positioned concentrically and spaced apart from the exhaust tube 12**.

Several clamping bands 46, though only one band is shown, are employed for connecting the heat shielding plate 40 to the exhaust tube 12. Each clamping band 46 has both ends formed into flange sections 48 and 50 which are respectively provided with holes **48*a* and 50*a*. The flange section 50 has at its sides downwardly bent sections 51** for increasing mechanical strength thereof.

In assembling these parts, a screw bolt 52, a nut 54 and a washer 56 are employed so as to not only fasten the heat insulating plate 40 to the flange section 50 of the clamping band 46, but also to firmly fasten the clamping band 46 onto the exhaust tube 12. Furthermore, the inwardly projecting top end of the embossed section 44 is firmly connected to the cylindrical outer surface of the exhaust tube 12 by means of welding.

Although, in this third embodiment, the heat shielding plate 40 is formed with a section of decreased diameter at one longitudinal end portion thereof, it is also possible to use a plate having generally the same diameter throughout the whole length thereof.

With the construction of this third embodiment, the longitudinal expansion of the exhaust tube 12 due to the heat in the tube 12 is made without damaging the arrangement of the heat shielding apparatus 10 by the same reasons stated hereinbefore.

Although, in the previous description, the heat shielding apparatus is stated to connect to the exhaust tube 12 having a generally circular cross section, it is also possible to use this type of heat shielding apparatus with the other members of the exhaust system such as a muffler and a catalytic converter.

It is to be understood that the invention is not to be limited to the exact construction shown and described and that various changes and modifications may be made without departing from the scope of the invention, as defined in the appended claims.

What is claimed is:

1. For use in a motor vehicle having an internal combustion engine and a body which is spaced from a road surface on which said vehicle stands, a combination comprising:

a cylindrical exhaust tube mounted in use beneath a body of a vehicle to allow the exhaust gases from an internal combustion engine to pass therethrough;

a rectangular heat shielding plate of lesser axial length than said tube provided with a longitudinally extending concave recess having at opposite lateral sides of said concave recess respective step portions extending along the length of the concave recess, the concave recess having a semicircular cross section the radius of which is larger than that of an outer cylindrical surface of said exhaust tube;

at least two axially spaced bridge members each having longitudinal ends respectively connected to said step portions and a middle portion transversely spanning said concave recess, said middle portion being bent toward a bottom of said concave recess to form a round section on which said exhaust tube is disposed in frictional contact therewith, the radius of said round section being smaller than that of said concave recess thereby to define a semicylindrical space between a surface of said heat shielding plate, defining said concave recess and an outer surface of said bridge member whereby a certain semicylindrical air space is defined between said surface of said concave recess and an outer surface of said exhaust tube; and at least two axially spaced bracket members each having longitudinal ends respectively connected to said step portions of said heat shielding plate and a middle portion covering said exhaust tube and in frictional contact therewith to attach said heat shielding plate to said exhaust tube in such a manner that the bottom of said concave recess is located between said exhaust tube and a road surface when said heat shielding plate is mounted on said exhaust tube and such that said heat shielding plate may move axially relative to said tube.

2. The combination as claimed in claim 1, in which the radius of said round section of said bridge member is generally the same as that of said outer cylindrical surface of said exhaust tube.

3. The combination as claimed in claim 2, in which the middle portion of said bracket member is bent radially outwardly from said concave recess to define a round section the radius of which is generally the same as that of said outer cylindrical surface of said exhaust tube.

4. The combination as claimed in claim 1, in which said ends of said bracket member are respectively disposed on said ends of said bridge member.

5. A combination as claimed in claim 1, in which said bracket member and said bridge member are positioned alternately axially along said exhaust tube.

* * * * *